US005706689A

United States Patent [19]

Nery

[11] Patent Number: 5,706,689

[45] Date of Patent: Jan. 13, 1998

[54] SINGLE-PIECE SELF-GUIDING HIGH MILL PLUG

[75] Inventor: Victor William Nery, Columbiana, Ohio

[73] Assignee: Victor W. Nery, Columbiana, Ohio

[21] Appl. No.: 818,290

[22] Filed: Mar. 14, 1997

Related U.S. Application Data

[63] Continuation of Ser. No. 401,925, Mar. 9, 1995, abandoned.

[51] Int. Cl.[6] ..... B21B 17/10; B21B 17/02

[52] U.S. Cl. ..... 72/209; 72/370; 72/208; 72/97

[58] Field of Search ..... 72/97, 208, 209, 72/370, 236

[56] References Cited

U.S. PATENT DOCUMENTS

| | | | |
|---|---|---|---|
| 3,577,754 | 5/1971 | Calmes | 72/209 |
| 3,946,586 | 3/1976 | Calmes | 72/208 |
| 4,015,460 | 4/1977 | Moore, Jr. | 72/97 |
| 4,091,650 | 5/1978 | Peytavin | 72/209 |
| 4,149,396 | 4/1979 | Meurer et al. | 72/209 |
| 5,201,357 | 4/1993 | Kuhn et al. | 164/365 |

FOREIGN PATENT DOCUMENTS

| | | | |
|---|---|---|---|
| 0522868 | 7/1976 | U.S.S.R. | 72/97 |

*Primary Examiner*—Lowell A. Larson
*Assistant Examiner*—Rodney A. Butler
*Attorney, Agent, or Firm*—Calfee, Halter & Griswold LLP

[57] ABSTRACT

A single-piece self-guiding, high integrity high mill plug for producing seamless tubular steel products in rolling mills is provided. The high mill plug is produced from a single a casting having a substantially bullet shape with an opening at each end and a passage therebetween to allow gases which develop during the casting process to escape. By designing the high mill plug to be produced from a single casting with no dead-end cores, the latent surface defects associated with the prior multi-piece casting designs are substantially avoided and the casting used to produce the single-piece self-guiding high mill plug has a very high integrity. The single-piece self-guiding high mill plug substantially improves rolling mill operations for producing seamless tubular steel products by eliminating both time and labor expenses associated with disassembling and reassembling the worn work plug sections as required by the prior art multi-piece high mill plug designs.

20 Claims, 3 Drawing Sheets

SINGLE-PIECE SELF-GUIDING HIGH MILL PLUG

This application is a continuation of application Ser. No. 08/401,925 filed on Mar. 9, 1995 abandoned.

FIELD OF THE INVENTION

This invention relates generally to plug devices for use in the production of seamless tubular steel products, and, more particularly, to single-piece self-guiding high mill plugs including a centering lead-in zone, a transition zone, a forming lead-in zone, and a work zone for use in rolling mill operations for the production of seamless tubular steel products.

BACKGROUND OF THE INVENTION

Rolling mills are used to transform steel shells into seamless pipe or tube. "Pipe" generally describes cylindrical tubular steel products made to standard combinations of outside diameter and wall thickness. "Tube" generally describes cylindrical tubular steel products which are not made to standard combinations of outside diameter and wall thickness. As described herein, "seamless tubular steel products" refer to both seamless pipe and seamless tube. Seamless tubular steel products are commonly used as conveyors of fluids or as structural members.

Seamless tubular steel products can be made by elongating a steel shell (i.e., a hollow steel cylinder) in a rolling mill. The rolling mill is configured with a series of high mill plugs arranged in a revolving array at the entry end of the rolling mill referred to as an "automatic plugger". The high mill plugs are positioned in separate chambers of the revolving array. The revolving array rotates to index a chamber into position at the entry end of the rolling mill and a heated steel shell is forced over the high mill plug. As the heated steel shell is forced over the high mill plug and formed into seamless tubular steel products by the compressive forces exerted by the rolls of the rolling mill, the high mill plug is heated. After the rolling operation is complete and the heated high mill plug is ejected back into its chamber of the automatic plugger, the revolving array indexes the chamber holding the heated high mill plug into a bosh to be cooled, and the next chamber is indexed into position with a cool high mill plug for the next successive rolling operation.

In a typical rolling operation cycle, a heated incoming steel shell is forced by a ram through the chamber that is holding the high mill plug tool. The front portion of the high mill plug slides into the opening of the steel shell, and the back portion of the high mill plug slides into a bar cap that is located at the end of a guide bar. The steel shell is forced onto the front end of the high mill plug, and the back end of the high mill plug is, in turn, forced onto the bar cap. This combination of a ram, a steel shell, a high mill plug, a bar cap, and a guide bar forms a "work assembly" in which all of these devices remain in substantially fixed position relative to one another. The ram forces this work assembly into the gorge of the rolling mill where the steel shell is worked by the revolving rolls. The gorge is the section of the rolling mill where the revolving rolls come closest together. The smallest distance between the revolving rolls is referred to as the "groove diameter". After the work assembly is positioned within the rolling mill, the guide bar stops moving and holds the high mill plug in a substantially fixed position along the longitudinal axis of the work assembly. The action of the rolls draws the steel shell over the high mill plug as it compresses the steel shell in the gorge area of the rolling mill. As the steel shell enters the gorge, the revolving rolls exert compressive forces on the outer surface of the steel shell to squeeze the steel shell over the work area of the high mill plug (which is functioning as a mandrel) so as to elongate the steel shell for producing a seamless tubular steel product having the desired dimensions.

The entering steel shell has a outer diameter which is slightly larger than the groove diameter of the rolling mill and an inner diameter which is slightly smaller than the outer diameter of the high mill plug. In addition, the high mill plug has an outer diameter which is slightly larger than the outer diameter of both the bar cap and the guide bar to provide sufficient clearance for allowing the seamless tubular steel product to pass over the bar cap and the guide bar without obstruction. Thus, as the ram forces the heated steel shell into the gorge of the rolling mill for exposure to the compressive forces of the revolving rolls, the heated steel shell is squeezed along the high mill plug to produce a seamless tubular steel product having an inner diameter corresponding to the outer diameter of the high mill plug and being slightly larger than the original steel shell inner diameter, an outer diameter corresponding to the groove diameter of the gorge and being slightly smaller than the original steel shell outer diameter, a wall cross-sectional area which is slightly smaller than the wall cross-sectional area of the incoming steel shell, and a length which is slightly longer than the original steel shell.

After completing the rolling process wherein a substantial portion of the steel shell has been rolled and squeezed out over the length of the guide bar, an ejector mechanism is used to eject the high mill plug from inside the newly formed seamless tubular steel product and into the chamber of the revolving array. The chamber is then be rotated to a new position and the next high mill plug which has been cooled in the bosh is indexed into position to receive the next heated steel shell to be worked. The revolving rolls are opened away from one another to allow the seamless tubular steel product to be pushed back through the rolls and the rolling process is repeated on successive steel shells.

In producing seamless tubular steel products, the rolling operation generally includes two passes of the steel shell through the rolling mill. The first pass uses a high mill plug having an outer diameter which is slightly larger than outer diameter of the high mill plug used during the second pass. In addition, prior to the second pass the steel shell is generally rotated through an axial angle of 90° relative to the shell's position in the first pass.

Two different types of self-guiding high mill plugs have been used heretofore. The first type of high mill plug generally consists of two separate plugs which are positioned along a common shaft in spaced-apart relationship relative to one another. The first plug is a guide plug which is positioned at the front end of the assembly on the shaft and which functions as a guide to center the shell as it enters the rolling mill. The second plug is a work plug which is positioned at the back end of the assembly on the shaft and which functions as a working surface on which the shell is rolled to establish the internal diameter of the seamless tubular steel product. In this first type of high mill plug, the guide plug and the work plug are maintained in spaced-apart relation along the common shaft through a series of springs, washers, bushings, etc. The second type of high mill plug generally is comprised of two separate plugs which are interlocked in integral relationship with one another. The first plug is a guide plug which forms the front end of the assembly and which functions as a guide to center the shell as it enters the rolling mill. The second plug is a work plug which forms the back end of the assembly and which functions as a working surface on which the shell is rolled to establish the internal diameter of the seamless tubular steel product. In this second type of high mill plug, a female connector located on the front section of the work plug is received by a male connector located on the back section of the guide plug, and the whole assembly is locked together with a locking device so as to maintain the guide plug and the work plug in interlocked relationship relative to one another.

Prior high mill plug designs incorporate multi-piece construction. For example, U.S. Pat. No. 4,015,460 issued to Moore shows various configurations of prior high mill plug designs which require interlocking a guide plug and a working plug with one another using connecting devices and locking devices or which require maintaining a guide plug and a working plug in spaced-apart relation on a common shaft using connecting and locking devices. In these prior designs, the high mill plug configuration requires the fabrication and assembly of multiple component parts. The multi-piece construction of these prior high mill plug assemblies requires time and labor to assemble and disassemble which in turn increases the cost of production of seamless tubular steel products. In addition, the multi-piece high mill plug assemblies are susceptible to malfunction resulting from incorrect assembly of the numerous components comprising the high mill plug, and are susceptible to malfunction resulting from defects in any one of the numerous components comprising the high mill plug assembly.

The multi-piece high mill plug assemblies are designed to allow the worn work plug section of the assembly to be replaced while retaining the original guide plug section of the assembly. While this configuration works well in many instances, it does have certain limitations. One disadvantage to this prior art configuration is that a multi-piece high mill plug configured with interchangeable components has added complexity of parts and increased production costs resulting from time and labor required for disassembly and reassembly operations. Another disadvantage of the prior art design is that both the lead-in plug (i.e., the guide plug) casting and the working plug (i.e., the work plug) casting each require a structure to allow the components to be interlocked as an assembly, and castings for guide plugs and the work plugs having such structure are complex to manufacture.

Another problem with the prior multi-piece high mill plug assemblies is difficulty encountered with establishing and maintaining uniform concentric geometries about the longitudinal centerline axis when guide plugs are repetitively disassembled and reassembled with other work plugs to produce the multi-piece high mill plug assembly. When a multi-piece high mill plug assembly does not maintain the guide plug and the work plug in a uniform concentric position about the longitudinal centerline axis through the assembly, centering effects result wherein the rolling mill operation produces seamless tubular steel products having non-circular shapes, non-uniform wall thickness, or both. The prior guide plug casting and work plug casting incorporate surface geometry designs to allow the two plugs to interlock with one another to minimize, but not eliminate, shifting of the guide plug and the work plug about the longitudinal centerline axis relative to one another. To minimize centering effects, the work plug casting is designed with a relatively large orifice immediately in front of the work area for receiving the interconnect structure of the guide plug, and this large orifice is immediately in front of the area subjected to the very high compressive forces of the revolving rolls of the rolling mill. However, by designing the work plug to minimize centering effects, the castability (i.e., the ability to create a high integrity casting with minimal surface and subsurface defects) of the prior design is compromised and results in a work plug design geometry that is susceptible to stress cracking.

Another disadvantage of the prior multi-piece high mill plug design is the incorporation of a bayonet-type connecting device for interconnecting the guide plug and the work plug with one another. This bayonet-type interconnect creates a design geometry with abrupt angles which are susceptible to stress cracking during rolling mill operations due to the tremendous compressive forces exerted on the work plug by the revolving rolls. Thus, the geometry of the guide plug casting design and the work plug casting design result in an inherently weak casting design susceptible to stress cracking.

Another disadvantage of the prior designs results from casting limitations imposed by the work plug design which incorporates a male connector interface geometry at one end for engaging a female bar cap located at the end of the guide bar. By designing the work plug section to have a male connector interface geometry at one end, it is necessary to cast the work plug using a dead-end core mold and this type of casting promotes latent surface defects due to the inability of gases to escape from the casting as it is being formed. These latent surface defects create a significant problem in rolling mill operations where the defects are typically not discovered until the seamless tubular steel products have reached subsequent processing stages. Even where surface defects are discovered prior to a high mill plug's entry into service, it is difficult to weld-repair a defective work plug because the casting is composed of high chrome steel which promotes the formation of interstices so as to create a boundary between the weld material and the original work plug material when attempts to weld-repair are made. When this occurs, the weld-repair material tends to separate from the original work plug material when exposed to the high stresses of rolling mill operations. These latent surface defects are very problematic when they appear during a production run and can result in substantial mill down time and large scrap losses.

Hence, while multi-piece high mill plugs have found certain applications in the prior art, there are certain drawbacks and certain situations which tend to result in less than optimal performance in rolling mill operations for producing seamless tubular steel products. Thus, the prior multi-piece high mill plugs do not provide an entirely satisfactory solution to certain problems encountered in the high temperatures and high pressures associated with rolling mill operations.

SUMMARY OF THE INVENTION

According to the present invention, a new single-piece self-guiding high mill plug for producing seamless tubular steel products from steel shells is provided.

In a first embodiment, the single-piece self-guiding high mill plug includes a conical shaped entry zone extending aft from a front end and a cylindrical shaped work zone extending forward from a back end. The single-piece self-guiding high mill plug includes a passage extending longitudinally therethrough that connects a nose cone aperture at the front end with a bar cap receiver aperture at the back end.

In a second embodiment, the single-piece self-guiding high mill plug has a front end, a back end, and a passage therebetween along a longitudinal centerline axis. The single-piece self-guiding high mill plug comprises a primary lead-in zone located aft of the front end and defining a first outer geometry that increases in diameter in correspondence with the distance aft of the front end along the centerline axis. The primary lead-in zone also has a nose cone that defines a first aperture connected to one end of the passage. The primary lead-in zone is configured for receiving and guiding steel shells. A transition zone is located immediately aft of the primary lead-in zone and defines a second outer geometry that increases in diameter in correspondence with the distance aft of the front end along the centerline axis. The transition zone is configured for guiding steel shells. A secondary lead-in zone is located immediately aft of the transition zone and defines a third outer geometry that increases in diameter in correspondence with the distance aft of the front end along the centerline axis. The secondary lead-in zone is configured for guiding steel shells. A work zone is located immediately aft of the secondary lead-in zone. The work zone has a plug base at the back end through which a bar cap receiver is defined, and a second aperture connected to the other end of the passage with the bar cap receiver. The work zone also defines a work surface located immediately aft of the secondary transition zone and defining a fourth outer geometry with a uniform outer diameter in correspondence with the distance aft of the front end along the centerline axis. The work zone also defines a standoff surface located aft of the work surface and defining a fifth outer geometry that decreases in diameter in correspondence with the distance aft of the front end along the centerline axis. The work surface is configured for working steel shells. A steel shell is worked in the work zone to decrease the cross sectional wall area of the steel shell and to thereby elongate the steel shell to produce the seamless tubular steel product.

DETAILED DESCRIPTION OF THE PREFERRED EMBODIMENTS

Figure 1:
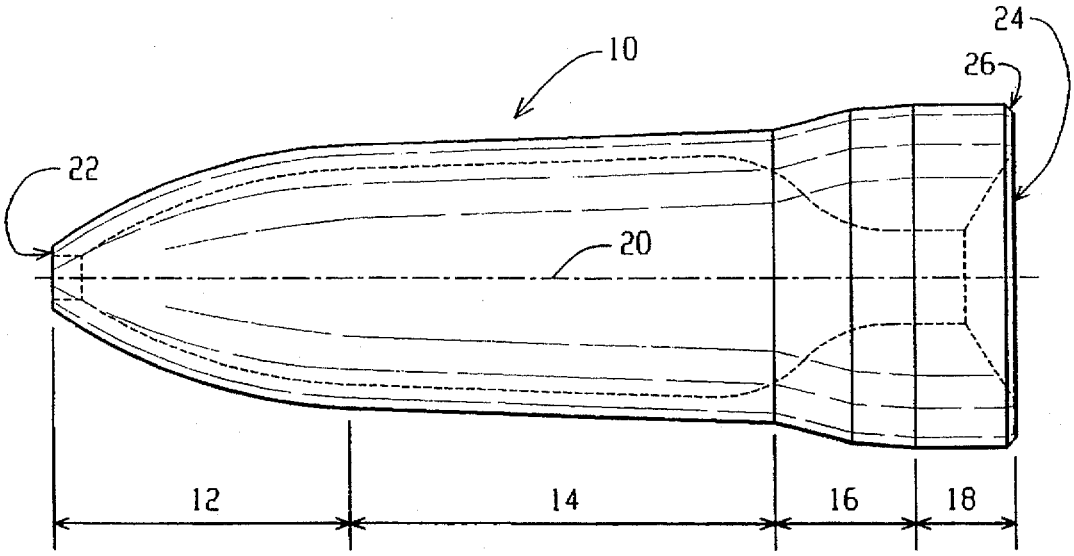
FIG. 1 is a side elevational view of a single-piece self-guiding high mill plug according to the present invention.
Figure 2:
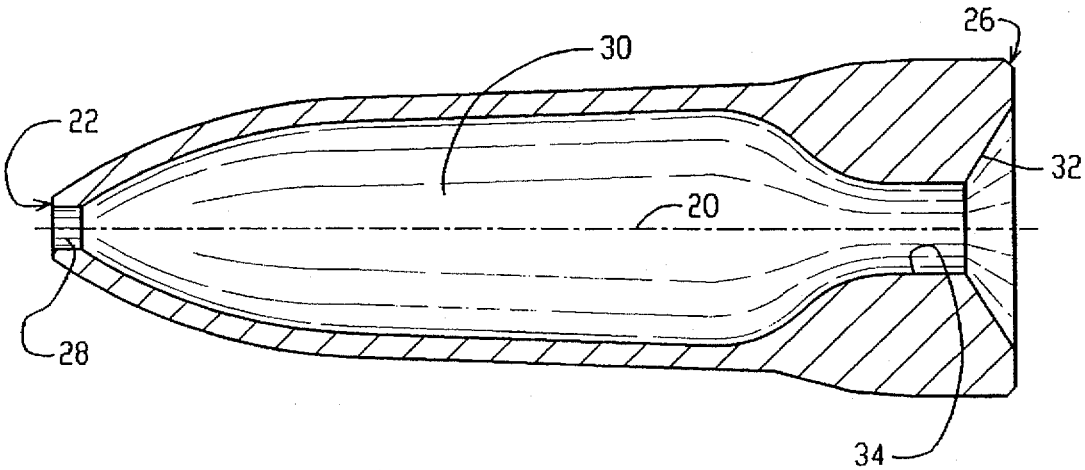
FIG. 2 is a sectional view of the single-piece self-guiding high mill plug taken through the longitudinal centerline axis.

According to the present invention, a single-piece self-guiding high mill plug is provided. The single-piece self-guiding high mill plug of the present invention integrates the lead-in section and the working section into a single-piece device rather than the multi-piece high mill plug assemblies previously used. FIG. 1 shows Single-Piece Self-Guiding High Mill Plug 10 of the present invention. Single-Piece Self-Guiding High Mill Plug 10 is formed from a single hollow casting and has a substantially bullet-shaped outer geometry. Primary Lead-In Zone 12, Transition Zone 14, Secondary Lead-in Zone 16, and Work Zone 18 are the four principal zones of Single-Piece Self-Guiding High Mill Plug 10 running longitudinally from front to back along Centerline Axis 20. Single-Piece Self-Guiding High Mill Plug 10 includes Nose Cone 22, Plug Base 24, and Standoff 26. Referring to FIG. 2, Nose Cone 22 and Nose Aperture 28 define the front opening of Passage 30 and Bar Cap Receiver 32 and Base Aperture 34 define the back opening of Passage 30. Nose Cone 22 defines a rounded edge at the front of Single-Piece Self-Guiding High Mill Plug 10. Bar Cap Receiver 32 defines a conical opening in the center of Plug Base 24. Passage 30 defines a hollow chamber extending from the front end of Single-Piece Self-Guiding High Mill Plug 10 and running to the back end of Single-Piece Self-Guiding High Mill Plug 10.

Figure 3:
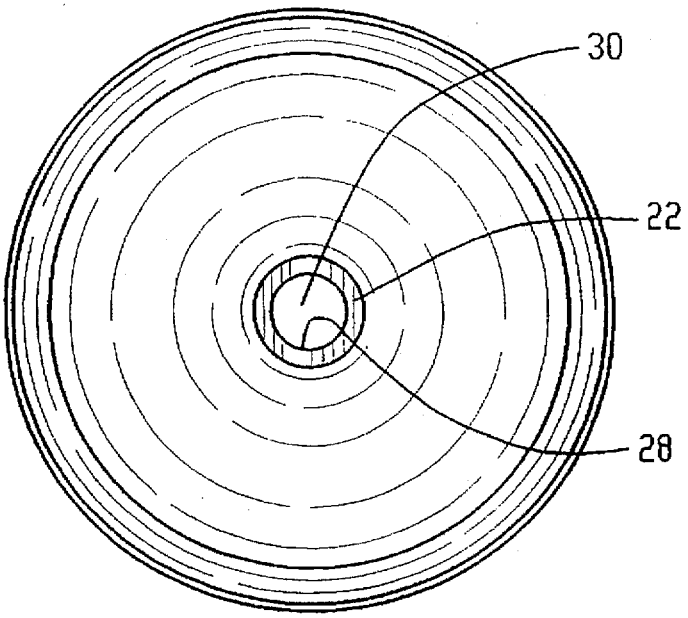
FIG. 3 is a front elevational view of FIG. 1.

Referring to FIG. 3, Nose Cone 22, Nose Aperture 28, and the front opening of Passage 30 are shown. In addition, Primary Lead-in Zone 12, Transition Zone 14, Secondary Lead-in Zone 16, and the edge of Work Zone 18 are also shown.

Figure 4:
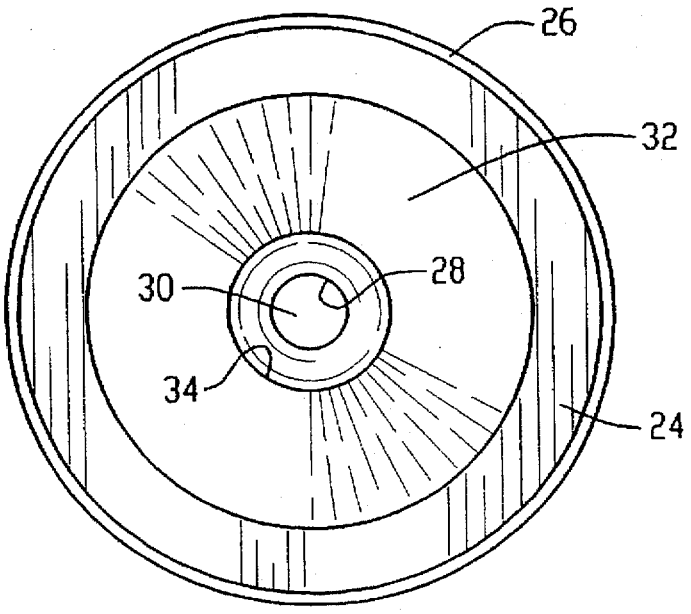
FIG. 4 is a rear elevational view of FIG. 1.

Referring to FIG. 4, Bar Cap Receiver 32, Base Aperture 34, and the back opening of Passage 30 are shown. In addition Plug Base 24 and Standoff 26 are also shown.

Figure 5:
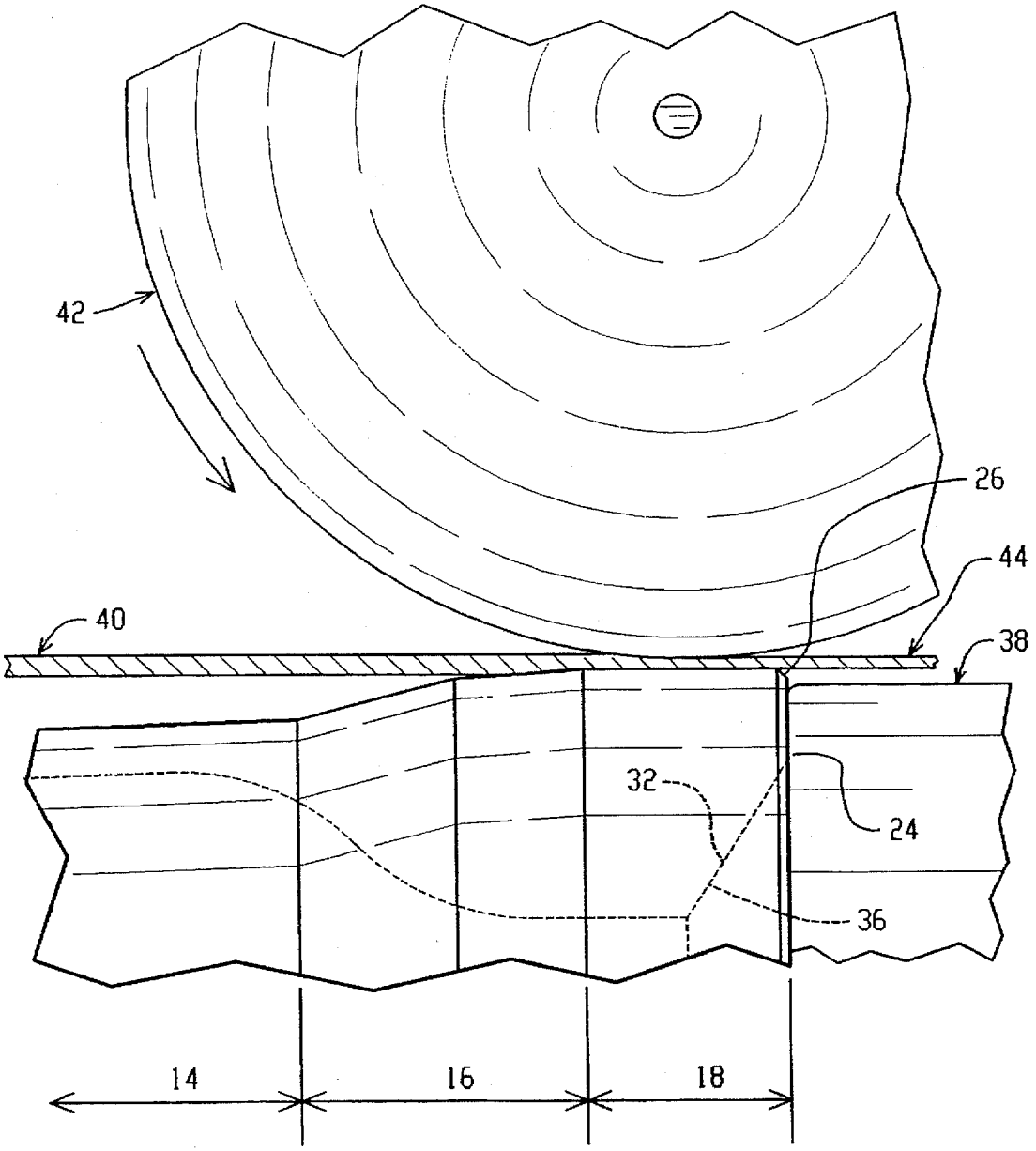
FIG. 5 is a side elevational view a steel shell engaging the work zone of the single-piece self-guiding high mill plug in the gorge of a rolling mill.

Referring now to FIG. 2, Passage 30 defines a hollow chamber through High Mill Plug 10 along Centerline Axis 20 and connects the opening of Nose Aperture 28 with the opening at Base Aperture 34. Nose Cone 22 and Nose Aperture 28 are configured to receive a fixture for ease of machining in producing Single-Piece Self-Guiding High Mill Plug 10 from an original single-piece hollow casting. Referring to FIG. 5, Bar Cap Receiver 32 and Base Aperture 34 are configured to receive Bar Cap 36 which is located at one end of Guide Bar 38 in the rolling mill.

The principal function of Primary Lead-in Zone 12, Transition Zone 14, and Secondary Lead-in Zone 16 is to guide or lead an entering steel shell to be forced onto Work Zone 18. The principal function of Work Zone 18 is to provide a rigid, uniformly concentric work surface over which the entering Steel Shell 40 passes to be worked by the Revolving Rolls 42 of the rolling mill to produce a Seamless Tubular Steel Product 44, as shown in FIG. 5. Stand-Off 26 functions as an exit section to allow burrs and other materials which have worn from Work Zone 18 and from the steel shell to be dispersed without scratching or otherwise damaging the inner surface of the seamless tubular steel product.

Single-Piece Self-Guiding High Mill Plug 10 of the present invention is designed for use as a mandrel in rolling mill operations in the production of seamless tubular steel products and functions similar to the prior multi-piece high mill plug assemblies. Single-Piece Self-Guiding High Mill Plug 10 is formed from a single casting having a relatively thin wall for Primary Lead-In Zone 12, Transition Zone 14, and Secondary Lead-In Zone 16, and having a relatively thick wall for Work Zone 18, as shown in FIG. 2. For typical seamless tubular steel product rolling mill operations, the relatively thin walls of Primary Lead-In Zone 12, Transition Zone 14, and Secondary Lead-In Zone 16 must be sufficiently thick to withstand the thermal stresses transferred to Single-Piece Self-Guiding High Mill Plug 10 from an entering steel shell having elevated temperatures as it is introduced into the rolling mill operation. Since the none of the relatively thin wall section of Single-Piece Self-Guiding High Mill Plug 10 is directly exposed to the high compressive forces and high working stresses associated with the revolving rolls working the steel shell, it is not necessary for the walls of Primary Lead-In Zone 12, Transition Zone 14, and Secondary Lead-In Zone 16 to have a thickness sufficient to withstand such forces. However, the wall of Work Zone 18 must be sufficiently thick to withstand direct exposure to the high compressive forces and high working stresses associated with the revolving rolls working the steel shell.

Single-Piece Self-Guiding High Mill Plug 10 has a substantially bullet-shaped outer surface geometry. Nose Cone 22 defines a rounded edge along the axis perpendicular to Centerline Axis 20 of Single-Piece Self-Guiding High Mill Plug 10. Primary Lead-In Zone 12 extends back to Transition Zone 14, with the outer surface defining a generally ellipsoid curve. This general shape of Primary Lead-In Zone 12 is preferred because it permits the entering steel shell to ride along the smoothly curved outer surface of Single-Piece Self-Guiding High Mill Plug 10 so as to allow Single-Piece Self-Guiding High Mill Plug 10 to be self-centering in the entering steel shell. Upon Primary Lead-in Zone of Single-Piece Self-Guiding High Mill Plug 10 becoming centered in the entering steel shell, physical contact between the steel shell and Transition Zone 14 is minimal.

Single-Piece Self-Guiding High Mill Plug 10 can be cast with either a circular or a non-circular (e.g., a triangle, a square, a pentagon, a hexagon, etc.) Nose Aperture 28 so that the casting can be easily setup in a jig or fixture for subsequent machining operations performed to produce the desired dimensional characteristics of Single-Piece Self-Guiding High Mill Plug 10. The shape of Nose Aperture 28 should be configured to easily receive the jig or fixture that is used to hold the casting in a machine during turning and other machining operations performed in producing Single-Piece Self-Guiding High Mill Plug 10. Initially, the casting is machined to establish the conical opening of Bar Cap Receiver 32 and to establish the longitudinal centerline of Centerline Axis 20. Upon establishing the longitudinal centerline, the outer surface of the casting is machined to form a uniform outer surface geometry about Centerline Axis 20 and to form a surface texture suitable for the intended application of Single-Piece Self-Guiding High Mill Plug 10. By designing Single-Piece Self-Guiding High Mill Plug 10 with Nose Aperture 28 having the shape of the jig or fixture that will be used for machining operations on Single-Piece Self-Guiding High Mill Plug 10, it is possible to machine the outer surface of Single-Piece Self-Guiding High Mill Plug 10 to be uniformly concentric about Centerline Axis 20 so as to avoid the centering effects inherent in the prior multi-piece high mill plug designs.

The opening defined by Bar Cap Receiver 32 is preferred to be conically shaped. Bar Cap Receiver 32 is adapted for receiving Bar Cap 36 to allow Single-Piece Self-Guiding High Mill Plug 10 to be self-centering inside the entering steel shell as the entering steel shell is forced onto Single-Piece Self-Guiding High Mill Plug 10 by a ram. In addition, the conically shaped opening defined by Bar Cap Receiver 32 allows Single-Piece Self-Guiding High Mill Plug 10 to be easily released from Bar Cap 36 on Guide Bar 38 at the end of each rolling operation. Upon Primary Lead-In Zone 12 becoming centered inside the entering steel shell, the ram continues to force the entering steel shell over Single-Piece Self-Guiding High Mill Plug 10 so as to stabilize Bar Cap Receiver 32 and Plug Base 24 against in Bar Cap 36 located on Guide Bar 38. Thus, Bar Cap 36 and Guide Bar 38 rigidly hold Single-Piece Self-Guiding High Mill Plug 10 in position about Centerline Axis 20 and Single-Piece Self-Guiding High Mill Plug 10 remains substantially free from wobble as the steel shell is worked in the rolling mill. In alternative embodiments, the single-piece self-guiding high mill plug of the present invention can be adapted to function with rolling mill configurations by incorporating an adaptor for mating the bar cap receiver and the plug base of the single-piece self-guiding high mill plug with alternative bar cap configurations or with alternative guide bar configurations of various rolling mills.

The single-piece casting used in producing Single-Piece Self-Guiding High Mill Plug 10 defines a relatively thin wall at Primary Lead-In Zone 12 and a relatively thick wall a Work Zone 18. The wall thickness gradually increases from the Primary lead-in Zone 12, through Transition Zone 14 and through Secondary Lead-in Zone 16, and substantially increases in thickness through Work Zone 18. The gradual increase in wall thickness extending aft from Primary Lead-In Zone 12 and through Transition Zone 14 and Secondary Lead-in Zone 16 is defined by a substantially smooth curvilinear geometry along both the outer surface and the inner surface. Work Zone 18 has a uniform outer diameter about Centerline Axis 20, with a slight decrease in outer diameter across Standoff 26. The wall thickness of Work Zone 18 becomes progressively thinner beginning at the back of Base Aperture 34 and moving back to Plug Base 24. The outer diameter of Standoff 26 is slightly smaller than the outer diameter of the working surface section of Work Zone 18 to allow the elongated steel shell (i.e., the just-formed seamless tubular steel product) to smoothly pass onto Guide Bar 38 without hanging up, and to avoid damaging the internal surface of the seamless tubular steel product with burrs which have formed on Work Zone 18 during the rolling operations. Thus, the overall geometry of Single-Piece Self-Guiding High Mill Plug 10 eliminates abrupt transitions and abrupt angles which are likely to produce stress cracking zones in the casting structure.

The outer geometry of the single-piece self-guiding high mill plug of the present invention is a function of the size of the seamless tubular steel product to be produced, the radius of the revolving rolls of the rolling mill, the groove diameter between the revolving rolls, the inner diameter of the steel shell, and the outer diameter of the steel shell. The single-piece self-guiding high mill plug's inner geometry and wall thickness are functions of casting design, rolling mill operating pressures, and steel shell temperatures.

In general, the life or wear-out period of high mill plugs is a function of the material used in producing the single-piece casting, surface treatments to the high mill plug, heat treating operations performed on the high mill plug, the steel shell temperature, the steel shell material, and the revolving rolls' compressive forces used producing the seamless tubular steel products. The single-piece self-guiding high mill plug of the present invention can be produced from various materials, with any given material composition being selected to conform with the rolling mill operation being used to produce the seamless tubular steel product. For many rolling mill operations, the single-piece self-guiding high mill plug is preferred to be made of a steel alloy having about 15% to about 25% chromium by weight, about 2% to about 10% nickel by weight, and about 1.0% to about 1.5% carbon by weight. However, other materials can be used in various applications because the high mill plug of the present invention is not limited to a specific material composition or alloy. Further, the high mill plug of the invention can undergo a variety of machining processes to produce specific surface finishes and specific shapes. Still further, the single-piece self-guiding high mill design of this invention can undergo a variety of surface treatments, including descaling and cleaning to produce a single-piece self-guiding high mill plug having the desired surface. Still further, the single-piece self-guiding high mill design of this invention can undergo a variety of heat treatments, including stress-relief heat treating, annealing heat treating, gas carburizing heat treating, and furnace atmosphere/surface carbon content controlled heat treating to produce a single-piece self-guiding high mill plug having the desired physical characteristics.

The casting used in producing the single-piece self-guiding high mill plug of the present invention has a passage which connects an opening at one end of the casting with an opening at the other end of the casting so as to form a vented-through casting design. This vented-through casting design used to produce the single-piece self-guiding high mill plug of the present invention creates a very high integrity casting. In producing the casting, molten metal is poured around a sand core and the gases generated within the sand core are allowed to escape through either of the two openings rather than remaining trapped in the casting and forming defects. Gases which are not permitted to escape the casting as it cools will blow out through the casting walls while the casting is still in a molten state and result in a casting being formed with holes or other related defects in the walls. The prior work plug is designed with an integral male bar cap. To produce such a work plug, it is necessary to pour the casting with a dead-end core casting to form the integral male bar cap at one end of the work plug. Such a dead-end core casting is not vented through, does not permit gases to easily escape, and, therefore, results in a low integrity casting with holes in the walls or other related defects. However, the casting used in producing the single-piece self-guiding high mill plug of the present invention is a vented-through design which results in a very high integrity casting. The casting design used in producing the present invention has an opening at each of two ends, and these two openings allow the casting to be poured in a vertical position such that gases formed as the casting cools can easily escape without producing holes in the casting walls or other related defects. By designing the casting to comprise two openings with a central connecting passage, the casting is vented through and allows the production of castings having very high integrity. Thus, the latent surface defects present in the prior multi-piece high mill assemblies, and which require reworking or repairing the work plug surface, are substantially eliminated in the present invention because the single-piece self-guiding casting does not promote formation of such latent surface defects.

In alternative embodiments of the single-piece self-guiding high mill plug of the present invention, surface treatments can be applied to produce the desired wear, lubricity, heat resistance, and other performance characteristics. The types of surface treatment which are applied are a function of the material composition or the metal alloy used to produce the high mill plug. In addition, for many applications the high mill plug can be produced from materials which are amenable to controlled atmosphere heat treatment in which the components of combustion are systematically altered to be dissimilar with open-air atmospheric combustion. For example, a high mill plug can be treated in an oxygen-rich atmosphere to control the deposition of carbon on the outer surfaces so as to produce a tightly bonded carbon deposition scale for providing a high mill plug having high lubricity to reduce frictional wear of the work surface as the steel shell is being rolled over the work surface, The single-piece self-guiding high mill plug of the present invention includes a bar cap receiver defining a female opening for receiving a male bar cap on the end of a guide bar provided by the rolling mill operator. Although high mill plugs have heretofore been made having the male bar cap integral with the high mill plug design, the high mill plug of the present invention can still be used in current rolling mill operations by incorporating an male adaptor onto the guide bars currently in use, or by welding an adaptor piece onto the back of the single-piece self-guiding high mill plug.

The single-piece self-guiding high mill plug of the present invention offers several other advantages over the prior art. By designing the high mill plug using single-piece construction, no maintenance must be performed to replace worn work plug sections, as required in the prior multi-piece high mill plug assemblies. Thus, the high mill plug of the present invention results in substantial savings in time and labor in rolling mill operations. Further, as the work zone section of the high mill plug of the present invention becomes worn, it can be easily remachined to turn down the outer surface for subsequent use in manufacturing smaller size of seamless tubular steel products without requiring disassembly and reassembly, as required in the prior multi-piece high mill plug assemblies. Still further, unlike the prior multi-piece high mill plug assemblies which require substantial time and labor to disassemble worn work plug sections prior to remelting operations for production of new high mill plugs, the single-piece self-guiding high mill plug of the present invention requires no time or labor for disassembly prior to reinsiting. Thus, the single-piece self-guiding high mill plug of the present invention results in substantial savings in time and labor by eliminating the requirement for disassembling worn work plug sections from the multi-piece assembly reassembling new work plug sections in the multi-piece assembly.

Another advantage of the single-piece self-guiding high mill plug of the present invention is that by having an opening both ends of the casting, the high mill plug can be easily machined to establish a precise longitudinal centerline, and, in turn, to establish a precise concentric outer surface geometry along the longitudinal centerline axis. The prior work plug casting is difficult to precision machine due its relatively low length-to-diameter ratio and due to its having an opening at only one end. In addition, the opening at each end of single-piece self-guiding high mill plug allows worn plugs to be easily precision-remachined by turning down the outer surface. In the prior multi-piece high mill plug assemblies, however, it is difficult to maintain a precise outer surface geometry about the longitudinal centerline when remachining the work plugs sections.

A further advantage of the single-piece self-guiding high mill plug of the present invention is the elimination of stress concentration zones which are associated with the prior multi-piece high mill plug assemblies. By designing a high mill plug having single-piece construction, the stress concentration zones associated with the abrupt angles of the interconnect structure for joining the guide plug and the work plug to into an assembly are eliminated.

While several embodiments of this invention have been shown and described, various adaptations and modifications can be made without departing from the scope of the invention as defined in the appended claims.

What is claimed is:

1. A single-piece self-guiding high mill plug, wherein said high mill plug has a front end, a back end, and a surface, said high mill plug comprising:

a. a conical shaped entry zone extending aft from a front end of said high mill plug, said conical shaped entry zone comprising a wall having an outer surface, an inner surface and an essentially uniform thickness between the inner and outer surface of said wall for a major portion of said entry zone;

b. a cylindrical shaped work zone extending forward from a back end of said high mill plug, said work zone having a bar cap receiver configured to receive a bar cap for centering said high mill plug in a workpiece and comprising a wall having an outer surface and an inner surface; and c. a passage extending longitudinally therethrough, said passage connecting a nose cone aperture at the front end of said high mill plug with said bar cap receiver aperture at the back end of said high mill plug;

wherein the inner surfaces of said entry zone and said work zone define the passage and wherein the wall of said cylindrical work zone zone has a thickness which is substantially greater than the thickness of the wall of said entry zone.

2. The single-piece self-guiding high mill plug of claim 1, wherein said high mill plug is formed as a unitary casting.

3. The single-piece self-guiding high mill plug of claim 1, wherein said high mill plug is heat treated for stress-relieving said high mill plug to minimize residual stresses and to produce the desired physical properties for said high mill plug.

4. The single-piece self-guiding high mill plug of claim 1, wherein said high mill plug is heat treated for annealing said high mill plug to soften said high mill plug and to produce the desired physical properties for said high mill plug.

5. The single-piece self-guiding high mill plug of claim 1, wherein said high mill plug is heat treated for gas carburizing said high mill plug to produce a hard surface on said high mill plug.

6. The single-piece self-guiding high mill plug of claim 1, wherein said high mill plug is heat treated for controlling furnace atmospheres and surface carbon content to produce a carbon deposition on said high mill plug.

7. The single-piece self-guiding high mill plug of claim 1, wherein the surface of said high mill plug is descaled and cleaned to produce the desired surface for said high mill plug.

8. The single-piece self-guiding high mill plug of claim 1, wherein the surface of said high mill plug is machined to produce the desired surface finish and the desired shape for said high mill plug.

9. The single-piece self-guiding high mill plug of claim 1, wherein said high mill plug is made of a steel alloy having about 15% to about 25% chromium by weight, having about 2% to about 10% nickel by weight, and having about 1.0% to about 1.5% carbon by weight.

10. The single-piece self-guiding high mill plug of claim 1, wherein said bar cap receiver defines a conical shaped opening centrally disposed about a longitudinal centerline through said passage.

11. A single-piece self-guiding high mill plug for producing a seamless tubular steel product from a steel shell, and wherein said high mill plug has a passage between a front end and a back end along a longitudinal centerline axis, said high mill plug comprising:

a. a primary lead-in zone located aft of the front end, said primary lead-in zone having a nose cone defining a first aperture connected to one end of the passage, said primary lead-in zone defining a first outer geometry that increases in diameter in correspondence with the distance aft of the front end along the centerline axis, said primary lead-in zone being configured for receiving and guiding the steel shell and having a wall with an outer surface, an inner surface, and an essentially uniform thickness between said inner and outer surface for a major portion of said primary lead-in zone;

b. a transition zone located immediately aft of said primary lead-in zone, said transition zone defining a second outer geometry that increases in diameter in correspondence with the distance aft of the front end along the centerline axis, said transition zone being configured for guiding the steel shell;

c. a secondary lead-in zone located immediately aft of said transition zone, said secondary lead-in zone defining a third outer geometry that increases in diameter in correspondence with the distance aft of the front end along the centerline axis, said secondary lead-in zone being configured for guiding the steel shell; and d. a work zone located immediately aft of said secondary lead-in zone, said work zone having a plug base at the back end and a bar cap receiver configured to receive a a bar cap for centering the bar cap in the steel shell, wherein said bar cap receiver is defined through said plug base and connects with the other end of the passage, said work zone defining (i) a work surface located immediately aft of said secondary transition zone, said work surface defining a fourth outer geometry with a uniform outer diameter in correspondence with the distance aft of the front end along the centerline axis, said work surface being configured for working the steel shell, (ii) and a standoff surface located aft of said work surface, said standoff surface having a fifth outer geometry that decreases in diameter in correspondence with the distance aft of the front end along the centerline axis, said work zone further having an inner surface and a wall between said inner surface and said work surface; wherein the steel shell is worked in said work zone to decrease the cross sectional wall area of the steel shell and to thereby elongate the steel shell to produce the seamless tubular steel product;

wherein the wall of said work zone has a thickness that is substantially greater than the thickness of the wall of said primary lead-in zone.

12. The single-piece self-guiding high mill plug of claim 11, wherein said high mill plug is formed as a unitary casting.

13. The single-piece self-guiding high mill plug of claim 11, wherein said high mill plug is heat treated for stress-relieving said high mill plug to minimize residual stresses and to produce the desired physical properties for said high mill plug.

14. The single-piece self-guiding high mill plug of claim 11, wherein said high mill plug is heat treated for annealing said high mill plug to soften said high mill plug and to produce the desired physical properties for said high mill plug.

15. The single-piece self-guiding high mill plug of claim 11, wherein said high mill plug is heat treated for gas carburizing said high mill plug to produce a hard surface on said high mill plug.

16. The single-piece self-guiding high mill plug of claim 11, wherein said high mill plug is heat treated for controlling furnace atmospheres and surface carbon content to produce a carbon deposition on said high mill plug.

17. The single-piece self-guiding high mill plug of claim 11, wherein the surface of said high mill plug is descaled and cleaned to produce the desired surface for said high mill plug.

18. The single-piece self-guiding high mill plug of claim 11, wherein the surface of said high mill plug is machined to produce the desired surface finish and the desired shape for said high mill plug.

19. The single-piece self-guiding high mill plug of claim 11, wherein said high mill plug is made of a steel alloy having about 15% to about 25% chromium by weight, having about 2% to about 10% nickel by weight, and having about 1.0% to about 1.5% carbon by weight.

20. The single-piece self-guiding high mill plug of claim 11, wherein said high mill plug defines a cross sectional wall area which increases along said secondary lead-in zone.

* * * * *